US005310071A

United States Patent [19]

Rivlin et al.

[11] Patent Number: 5,310,071

[45] Date of Patent: May 10, 1994

[54] DUAL-PURPOSE FOOD CONTAINER/BUILDING BLOCK ELEMENT

[76] Inventors: Eitan Rivlin, 22 Zondek Street, Jerusalem; Yossi Walker, 15 Hagoren Street, Efrat, both of Israel

[21] Appl. No.: 966,310

[22] Filed: Oct. 26, 1992

[30] Foreign Application Priority Data

Oct. 28, 1991 [IL] Israel ..... 99872
Oct. 21, 1992 [IL] Israel ..... 103482

[51] Int. Cl.[5] ..... B65D 81/00
[52] U.S. Cl. ..... 220/23.4; 206/509
[58] Field of Search ..... 220/23.4, 23.6, 23.83; 206/509

[56] References Cited

U.S. PATENT DOCUMENTS

| | | | |
|---|---|---|---|
| 3,338,452 | 8/1967 | Oakley et al. | 220/23.4 |
| 3,391,824 | 7/1968 | Wiseman | 206/509 X |
| 4,250,847 | 3/1981 | Nierman | 220/23.4 X |
| 4,770,297 | 9/1988 | Chang | 220/23.4 X |
| 4,919,268 | 4/1990 | Young et al. | 220/23.6 X |
| 5,002,199 | 3/1991 | Frahm | 206/509 X |
| 5,050,755 | 9/1991 | Strawder | 220/23.4 |

FOREIGN PATENT DOCUMENTS 236854 3/1964 Fed. Rep. of Germany ..... 220/23.4

*Primary Examiner*—Steven M. Pollard
*Attorney, Agent, or Firm*—Edward Langer

[57] ABSTRACT

A dual-purpose sealable food container / building block element comprising an upper portion and a bottom portion, the upper portion being open, characterized in that at least one of the upper portion and the bottom portion is provided with at least one connecting member, such that a plurality of the container/elements are connectable to one another by engaging the connecting members and sliding toward each other along the connecting members, for use of the container/elements as a toy after completing original use as a food container. By assembling a plurality of food containers in the play mode, three-dimensional structures may be created. In order to enable such large constructions to be firm and steady, the connecting members are of the slide type, engageable by insertion of rails at the open ends of sockets and sliding longitudinally into each other, perpendicular to the forces acting on assembled building blocks. This type of connection does not depend on friction as the main holding force, and is not easily separated.

18 Claims, 8 Drawing Sheets

DUAL-PURPOSE FOOD CONTAINER/BUILDING BLOCK ELEMENT

FIELD OF THE INVENTION

The present invention relates to a dual-purpose sealable container / building block element, particularly useful as a food container. More particularly, the invention is directed to a food container which may also be used as a building block assembly toy after completing its primary use as a container. Specifically, such containers are mostly used for dairy products such as ice cream, yogurt or the like.

BACKGROUND OF THE INVENTION

Various containers arranged for connection one to another are known in the prior art of storage systems, for example as shown in U.S. Pat. No. 3,99,818 to Schankler. The patent discloses an interlocking system of identical modules for storage of microfilm cartridges or boxes, particularly in a carousel arrangement. There is no provision for sealing the front end of the modules.

U.S. Pat. No. 4,592,601 to Hlinsky et al. discloses an expandable modular storage system for holding slides and cassettes, using screws for interlocking adjacent elements. Modular storage units for useful as furniture items are disclosed in U.S. Pat. No. 4,717,214 to Moore et al. The modular units are each formed from identical hingedly connected rectangular panels.

An interlocking modular display rack system is disclosed in U.S. Pat. No. 4,480,745 to Loge et al., featuring a set of open, non-sealable holders for supporting article caddies.

U.S. Pat. No. 4,423,913 to Lee discloses a display and storage assembly using interlocking stackable open bins, designed to be interlocked in a juxtaposed side-by-side relationship.

Other examples of stackable and interlocking containers or boxes are disclosed in U.S. Pat. Nos. 3,514,170 to Shewchuk and 3,506,321 to Hampel. Neither of these designs is sealable.

U.S. Pat. No. 3,131,829 to Masser discloses an article-carrying container, which is not sealable.

In the area of food packaging containers, it is known to use open top cup-like containers made out of plastic which are manufactured by the injection or vacuum molding process, and sealed by bonded or folded aluminum foil or by elastic-type plastic covers. These containers are especially useful for such applications as dairy products which usually have short shelf lives. Most containers used today are disposable, having no other use once the original contents are emptied, thus causing a litter problem.

Building block assembly toys are well known and used by children throughout the world, and are available in various shapes and sizes. Many kinds of connecting means are used, most of them of the push-pull variety, with material elasticity and friction as the joining method, exhibiting only modest holding force.

Most building blocks available are small in size, relative to the child's environment. The reason that larger building blocks are not found on the market is that the production, storage and delivery prices for such would exceed the average family's toy budget.

U.S. Pat. No. 4,764,143 to Gat et al. discloses an assembly toy for joining cylindrical objects.

Using empty containers as toys has been suggested in French Patent No. 2549610, which describes a container such as that mentioned above with a relief of a face or other shape on the bottom for shaping soft materials or cookies, but not suitable as a constructional toy.

Another invention of this type is found in Israeli Patent No. 33024, which describes a bottle with projections and recesses which can be interconnected at many relative positions with the push-pull method of connection. This patent shows good three dimensional construction ability, but the connection is too weak for larger constructions.

It is thus an object of the present invention to provide a food container with connecting features which permit it to be used as a building block assembly toy after the contents are emptied.

It is another object of the invention to provide building blocks suitable for building large structures, thereby reducing the expenses of buying special assembly toys as well as reducing the litter problem posed by disposable containers.

It is still another object of the present invention to provide a food container adequate for building large, complex three-dimensional structures in the play mode, using only empty containers.

SUMMARY OF THE INVENTION

Accordingly, it is a principal object of the present invention to provide a dual-purpose food container / building block element for use in food storage and play modes.

In accordance with a preferred embodiment of the present invention, there is provided a dual-purpose sealable food container / building block element comprising an upper portion and a bottom portion, said upper portion being open, characterized in that at least one of said upper portion and said bottom portion is provided with at least one connecting means, such that a plurality of said container/elements are connectable to one another by engaging said connecting means and sliding toward each other along said connecting means, for use of said container/elements as a toy after completing original use as a food container.

While reference is made throughout the specification to "food containers," it is understood that the invention is not limited to such containers, and can be exploited in connection with any other uses made of the container prior to its exploitation as a building block, since its actual contents prior to such use are not an aspect of the invention. Thus, for example, empty containers which have never contained food, e.g. excess production leftovers, can also be used for purposes of the invention. Since, however, in most cases, the building block is conveniently available after prior use as a food container, reference to "food container" is made for the sake of brevity.

According to a preferred embodiment of the invention, the connecting means comprises a set of rails and sockets on the upper and bottom portions, which are slidingly engageable.

The container can be of any shape, for example, substantially tubular in shape, or substantially parallelepipedal in shape.

According to a preferred embodiment of the invention, the element is adapted to be used as a food container. In such embodiment it is preferably provided with a rim positioned around the upper open portion thereof and protruding outwardly therefrom. The rim is conventionally used for sealing purposes, although all or part of it can be used as a functional stopping means for the purposes of the invention.

However, after the element has served its purpose as a food container, part of the rim can be removed by tearing it at a weak point formed during production. Thus, the lip surrounding the top open face is used for sealing purposes, by aluminum foil, flexible plastic cover, or by any other method, when in use as a food container, and the lip is used as a stopper in the play mode, alone or incombination with small projections, limiting the extent of travel of the engaged rails.

Sets comprising a combination of a plurality of elements according to the invention, wherein each two or more elements are connected to one another by the connecting rails and sockets, also forms a part of the present invention.

In another embodiment, a particularly convenient dualpurpose sealable food container / building block element, is provided with connecting rails and sockets which are asymmetric in shape.

By assembling a plurality of food containers in the play mode, three-dimensional structures may be created. In order to enable such large constructions to be firm and steady, the connecting means are of the slide type, engageable by insertion of rails at the open ends of sockets and sliding longitudinally into each other, perpendicular to the forces acting on assembled building blocks. This type of connection does not depend on friction as the main holding force, and is not easily separated.

To achieve the most versatile construction ability, the design features two connecting rails provided on opposite side walls directly opposite one another, and the connecting rail on the bottom is rotated ninety degrees about center with respect to the wall rails.

A further improvement in stability is achieved if all connecting means are each composed of two or more equally distanced rail or-socket pairs. Since the rail or socket pairs are separated, the connection is less affected by external moments acting or the assembled game blocks.

In order to make assembly possible using containers with the top faces in different directions, the arithmetic ratio between height and width is kept, so that the total height of two side-to-side assembled containers, engaged to the stop position defined by the lip, measured from the bottom of one to the bottom of the other, is the same as the total width of a single container measured at both sides.

In yet another embodiment, improved rigidity of an individual container and of an assembly is achieved due to the fact that the lip surrounding the top open face is connected to the wall connecting means, and the wall connecting means are connected to the bottom connecting means directly or by internal or external ribs which do not obstruct the open ends of the connecting means. The addition of connecting means does not add significant weight to the thin-walled food container, yet the container strength is greatly increased.

Since the invention is ultimately directed to use as a children's toy, it is important that the elements according to the invention be attractive to children. Advantages of the invention, therefore, consist in achieving a fascinating, colorful game as a by-product of packaging, with the benefits of relatively large size, at virtually no cost.

Yet another advantage of the invention is that only one type of container is sufficient for building any size and shape in all directions in the play mode, eliminating the need for manufacturing other special elements, e.g., connecting elements, not required for packaging.

Further advantages include solutions to the litter problem caused by the disposal of empty containers, and the possibility of using the connecting rails as an attachment point for an automatic filling machine, or when shipping.

Creating complex structures requires planning and use of imagination, which contribute to the development of the child, and his or her enrichment in the field of space geometry. This kind of play can engage children of a wide range of ages, according to the individual child's abilities and disposition.

Other features and advantages of the invention will become apparent from the following drawings and description.

BRIEF DESCRIPTION OF THE DRAWINGS

For a better understanding of the invention with regard to the embodiments thereof, reference is made to the accompanying drawings, in which like numeral designate corresponding elements or sections throughout, and in which.

DETAILED DESCRIPTION OF THE PREFERRED EMBODIMENTS

Figure 1:
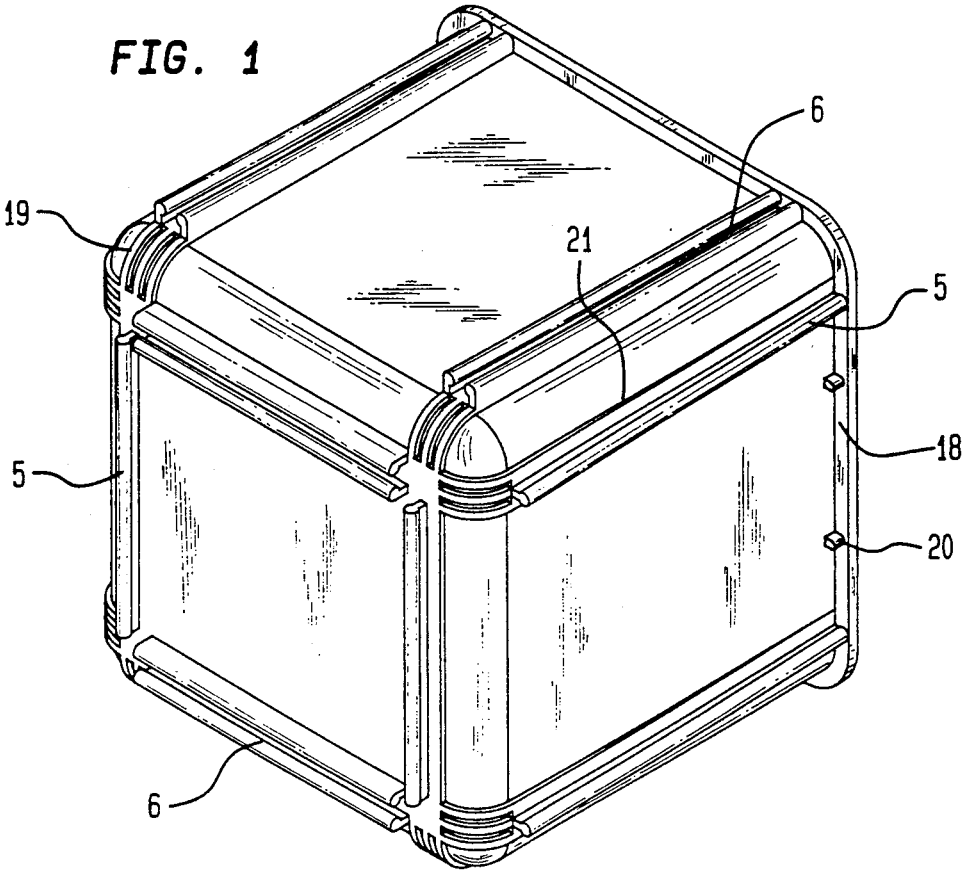
FIG. 1 is a perspective view of a preferred embodiment of the invention, showing the bottom and two walls of a cubeshaped container.
Figure 2:
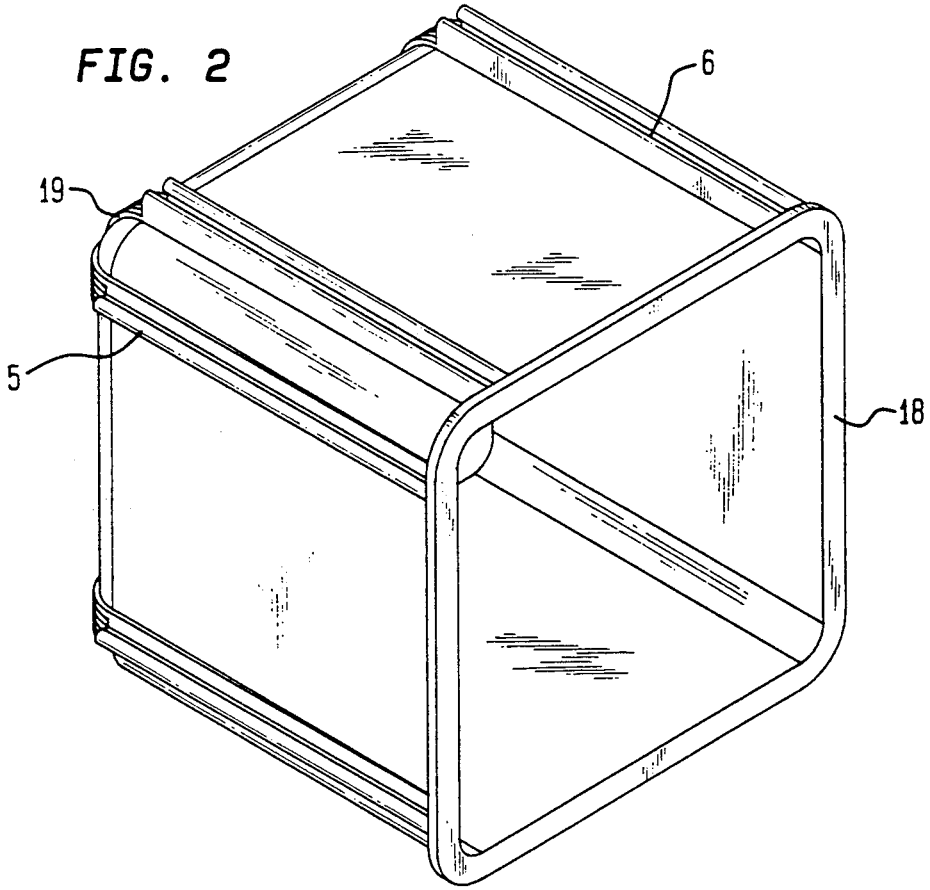
FIG. 2 is another perspective view of the same embodiment as in FIG. 1, snowing an open top face and two walls.
Figure 3:
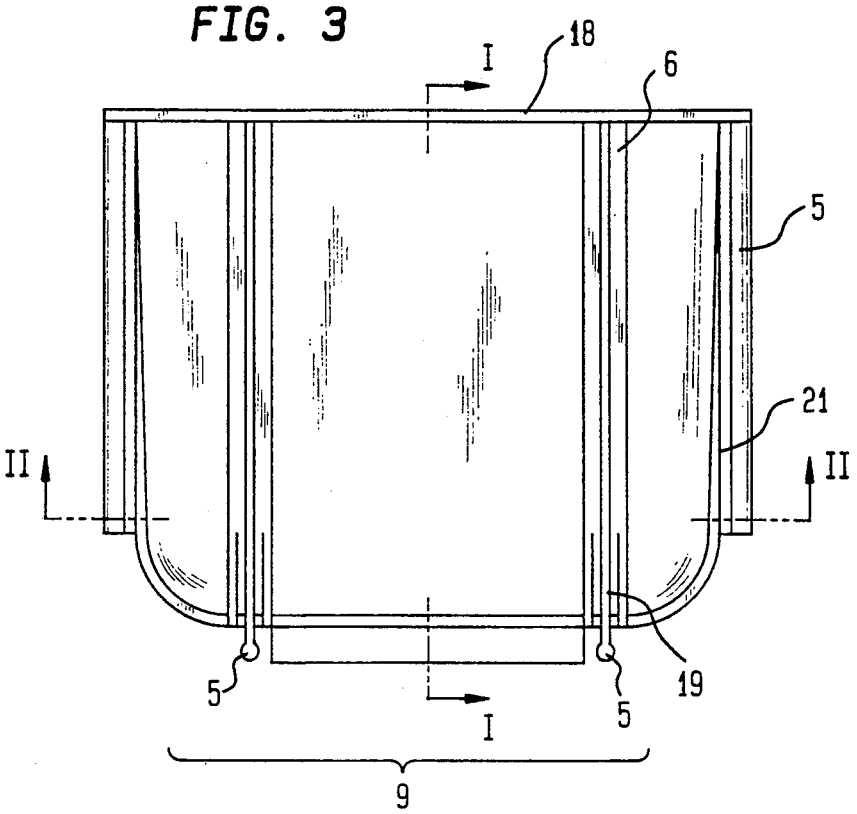
FIG. 3 is a front view of the same embodiment of the invention as in FIG. 1.
Figure 4:
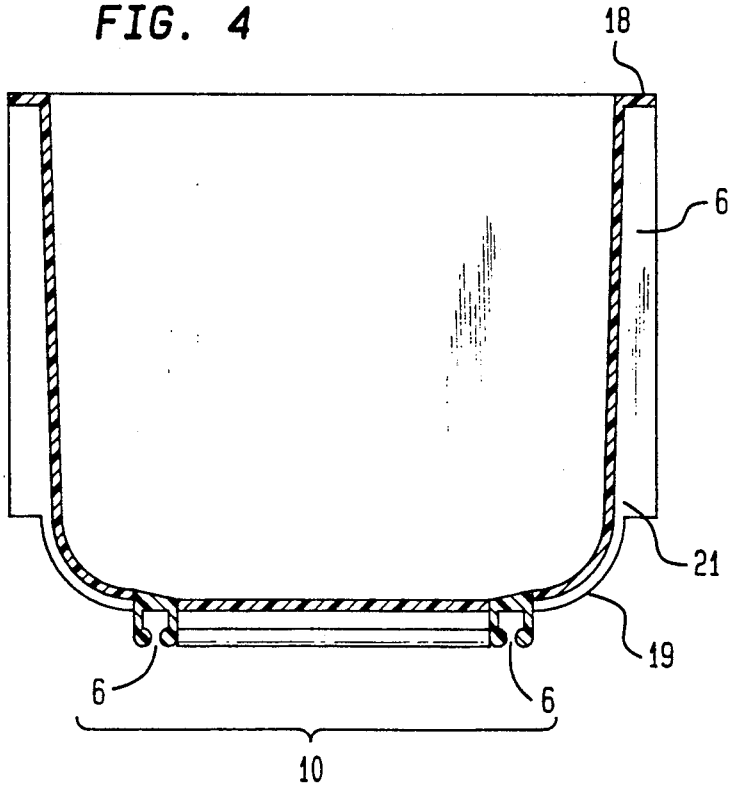
FIG. 4 shows a cross-section along plane I—I of FIG. 3.
Figure 5:
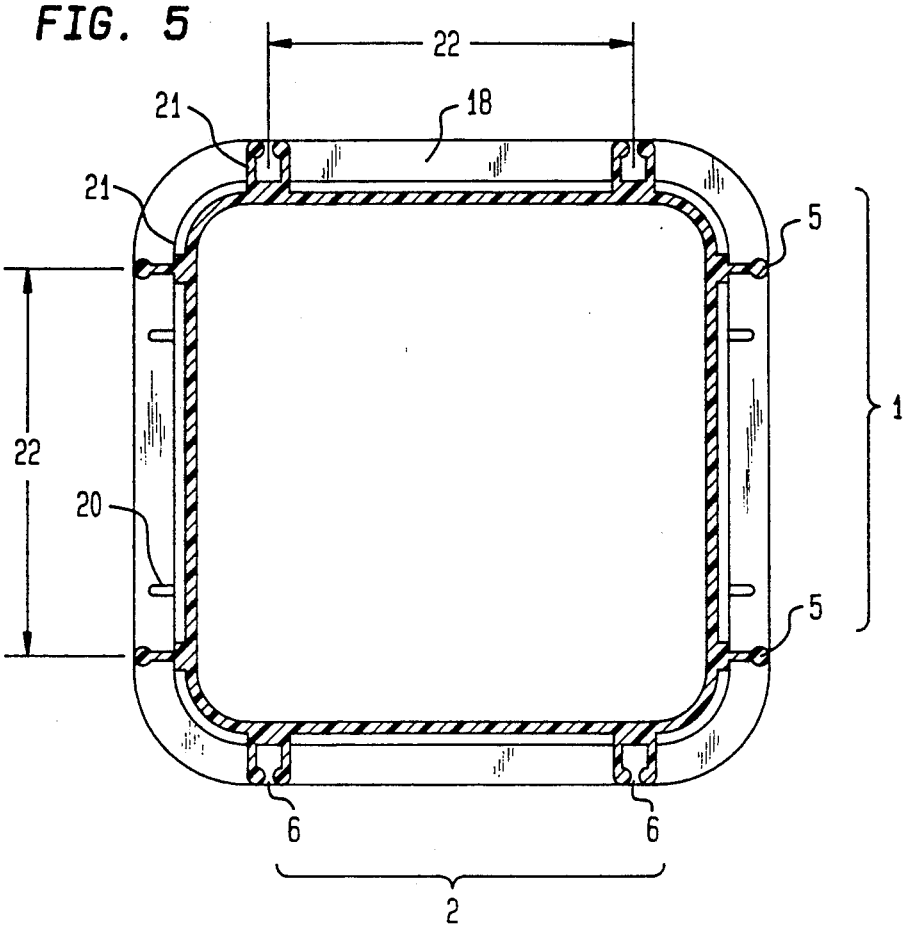
FIG. 5 shows a cross-section taken along plane II—II of FIG. 3.

A food container constructed in accordance with the invention is shown in FIGS. 1-9. The container is typically made of plastic, and is manufactured by the injection molding process, from one part or a few bonded pieces (FIGS. 8, 9), shaped as a rounded-edge cube truncated just below the top rounded edges, to provide an open top face, surrounded by a lip 18 outwardly protruding at the top. Lip 18 can be of any desired shape to support the preferred type of sealing.

Two pairs 1 and 2 of connecting rails and sockets, each composed of individual rails 5 and sockets 6 , respectively, protrude outwardly from each of the four side surfaces. Bottom connecting rail and socket pairs 9 and 10 FIGS. 3–4), comprising individual rails 5 and sockets 6, respectively, protrude outwardly from the bottom surface.

The walls preferably taper outwardly from the bottom and are provided with wedges 21 tapering inwardly from the top to keep the rails horizontal. Side rail and socket pairs 1 and 2 are attached directly to lip 18 so that the top of the rails 5 and sockets 6 is covered. The lower end of rail and socket pairs 1 and 2 are connected to bottom rails 5 and sockets 6 at the bottom surfaces by wedges 21 followed by external ribs 19, which are low enough so as not to obstruct the lower end of the rails 5 and sockets 6. The container framework including the top lip 18, the side rail and socket pairs 1 and 2, stiffening ribs 19 and bottom rail and socket pairs 9 and 10, provides the container with the required strength.

Figure 6:
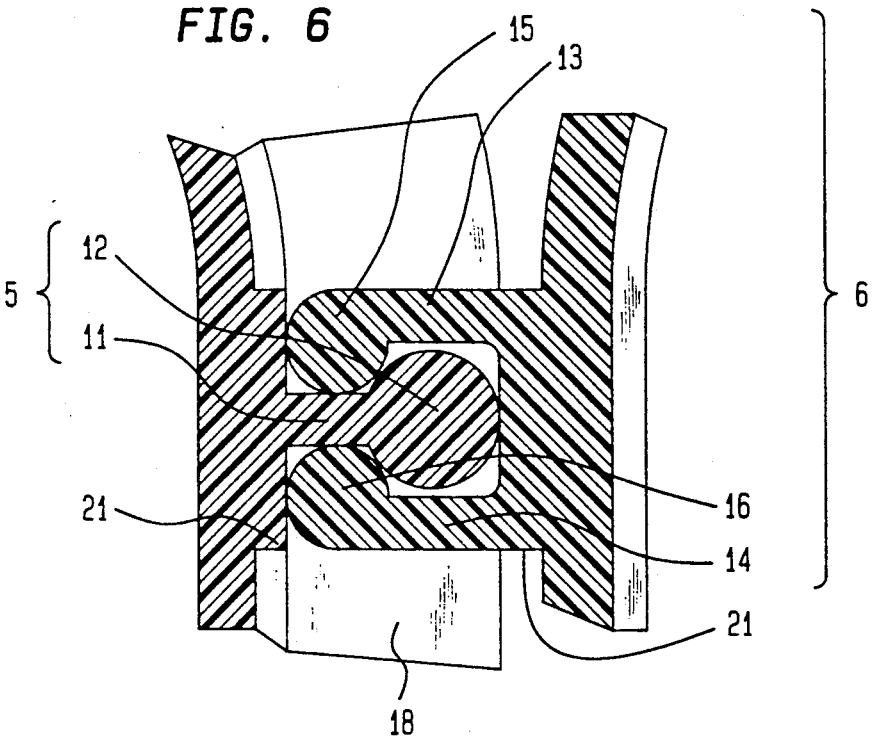
FIG. 6 is a detailed cross-section of the same plane as in FIG. 5, showing the engagement of rails and sockets.

As shown in FIG. 6, rails 5 comprise a strip 11 protruding from the surface, with a cylinder 12 integrally formed thereon, and sockets 6 comprise two strips 13 and 14, protruding from the surface, each with a respective cylinder 15 and 16 integrally formed thereon. The distance between strips 13 and 14 and cylinders 15 and 16 in sockets 6 is such that rails 5 will interlock therein by a sliding movement with light pressure. Contact is made with the rail cylinder 12 at three points on its circumference, one point directly contacting the other container wall between the two strips 13, 14 of the socket 6 in which it is engaged, with the other two points being on the cylinders 15, 16 of the socket 6, while pushing those cylinders slightly outwards.

Strips 13 and 14 of the socket 6 are not centered with the cylinders 15 and 16. The distance between the centers of the strips is greater than the distance between the centers of the cylinders, to allow room for rail cylinder 12. The socket strips and 14 are also thicker than the rail strip 11 because of the bending force acting while in engagement.

The connecting rails are arranged in such a manner that on two opposing walls there are rail pairs 1, each comprising two rails 5 with a fixed gap 22 (see FIG. 5) separating them, and on the other two opposing walls there are socket pairs 2, each comprising sockets 6 with the same gap 22 separating them. On the bottom surface there are provided rail pair 9 and socket pair 10, each comprising individual rails 5 and sockets 6 with the same fixed gap 22 separating them.

The bottom surface rails and sockets are perpendicular to each other, symmetrically arranged around the bottom center, and set at an angle of 90 degrees with respect to the wall rails and sockets of the same type, in such a manner that bottom rail pair 9 between side wall rail pair I and bottom socket pair 10 between side wall socket pair 2 appearing in the same direction are of the opposite type. Bottom rail pair 9 is shorter in length than gap 22 and bottom socket pair 10 is shorter in length than gap 22, to avoid obstruction of rail ends at the corners formed between them.

Figure 7:
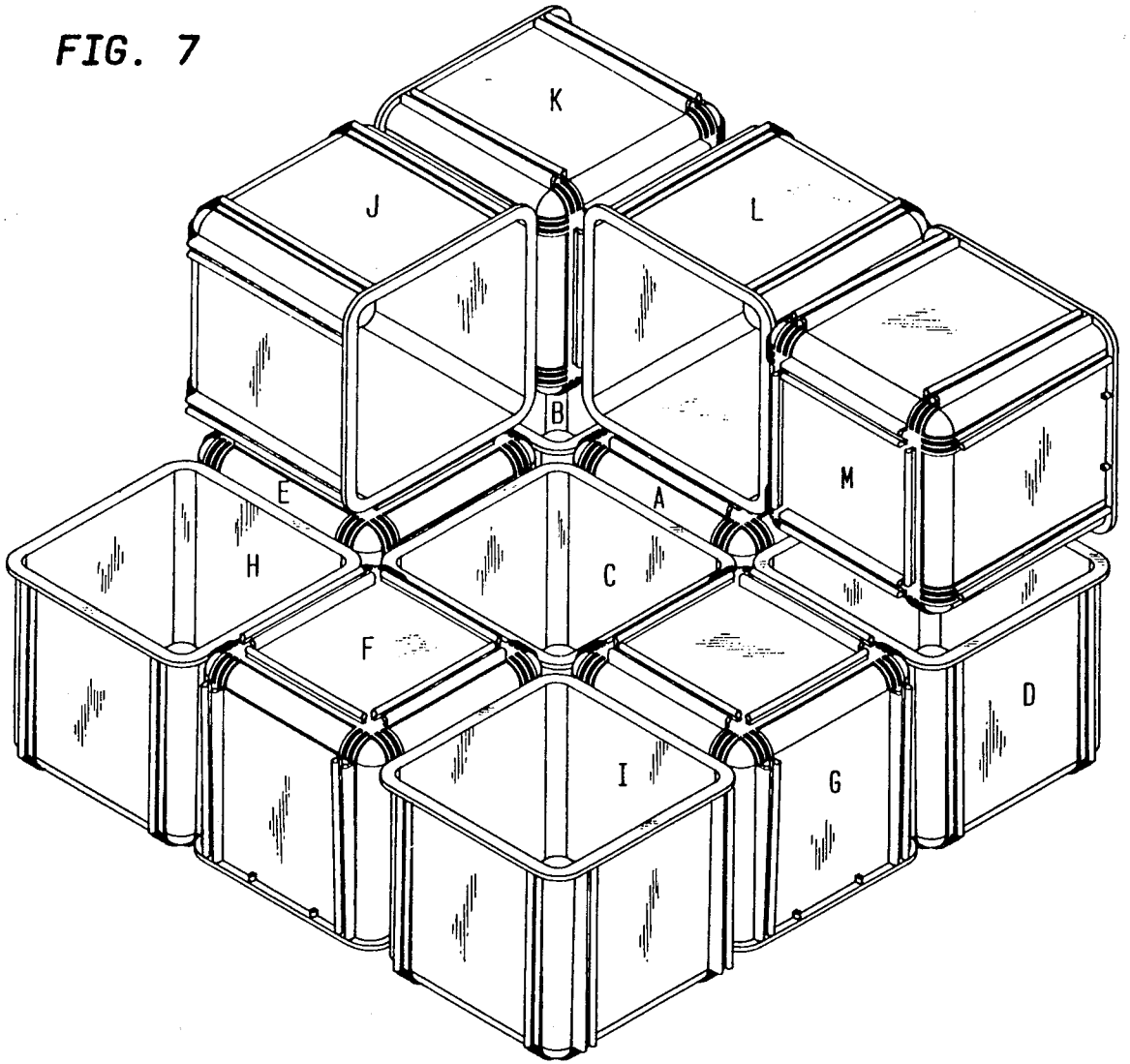
FIG. 7 is a perspective view of thirteen assembled containers.
Figure 11:
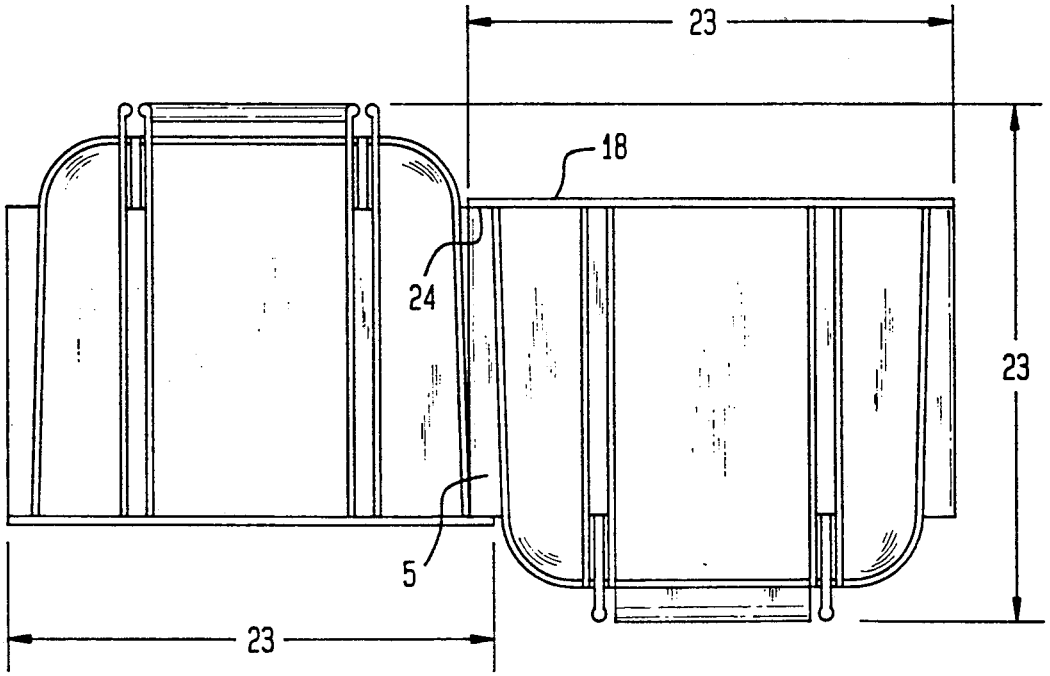
FIG. 11 shows two side-to-side assembled containers with relative dimensions.

The food containers may be assembled together (see FIG. 7 by engaging the rails of one container with the sockets of another and pushing the containers in parallel and in opposite directions until the displacement along the rails 5 is stopped by top lip 18, at contact point 24 (FIG. 11). When assembling the containers with surfaces side-to-side, one of the containers must be turned upside down so the openings of the rails and sockets are facing each other. When assembling side to bottom surfaces, they can be assembled in both directions because the bottom rails are open at both ends. Bottom surfaces do not engage one another.

Furthermore, small projections 20 are provided at the bottom of lip 18, between the two rails 5 of rail pair 1 at both sides of the container, and these projections 20 are needed only when assembling bottom socket pair 10 to side rail pair 1, to serve as a stop in the particular case in which there is no other contact between lip 18 and the bottom socket pair 9 at the exact stop position.

When assembling two containers with side-to-side surfaces to the stop position (see FIG. 11), the total height 23, measured from the bottom of one container to the bottom of the other, will be the same as the total width 23 of one container measured at either of the two sides. This important fact makes it possible to connect each of the two side surfaces of a container, respectively, one side to a side surface of one container and one side to a bottom surface of another container, which are already installed in a group of assembled containers.

The order of constructing the cubic assembly of FIG. 7 is the order of the letters marked on the containers. First a surface is created by assembling A–I containers side-to-side surfaces, then J–M containers are added and are connected side to bottom surfaces alternately to the existing surface and side-to-side surfaces between them, excluding the corner in which containers K–L are connected bottom to side surfaces. It can be continued, connecting containers in all directions and even creating spaces big enough for a child to enter.

It should be noted that the L container, for example, is engaged simultaneously with containers A, K directed from above container C outwardly. This is possible since the radius of the bottom edges enables the bottoms of A and K containers to extend over the lip of C and J containers when fully engaged.

Figure 8:
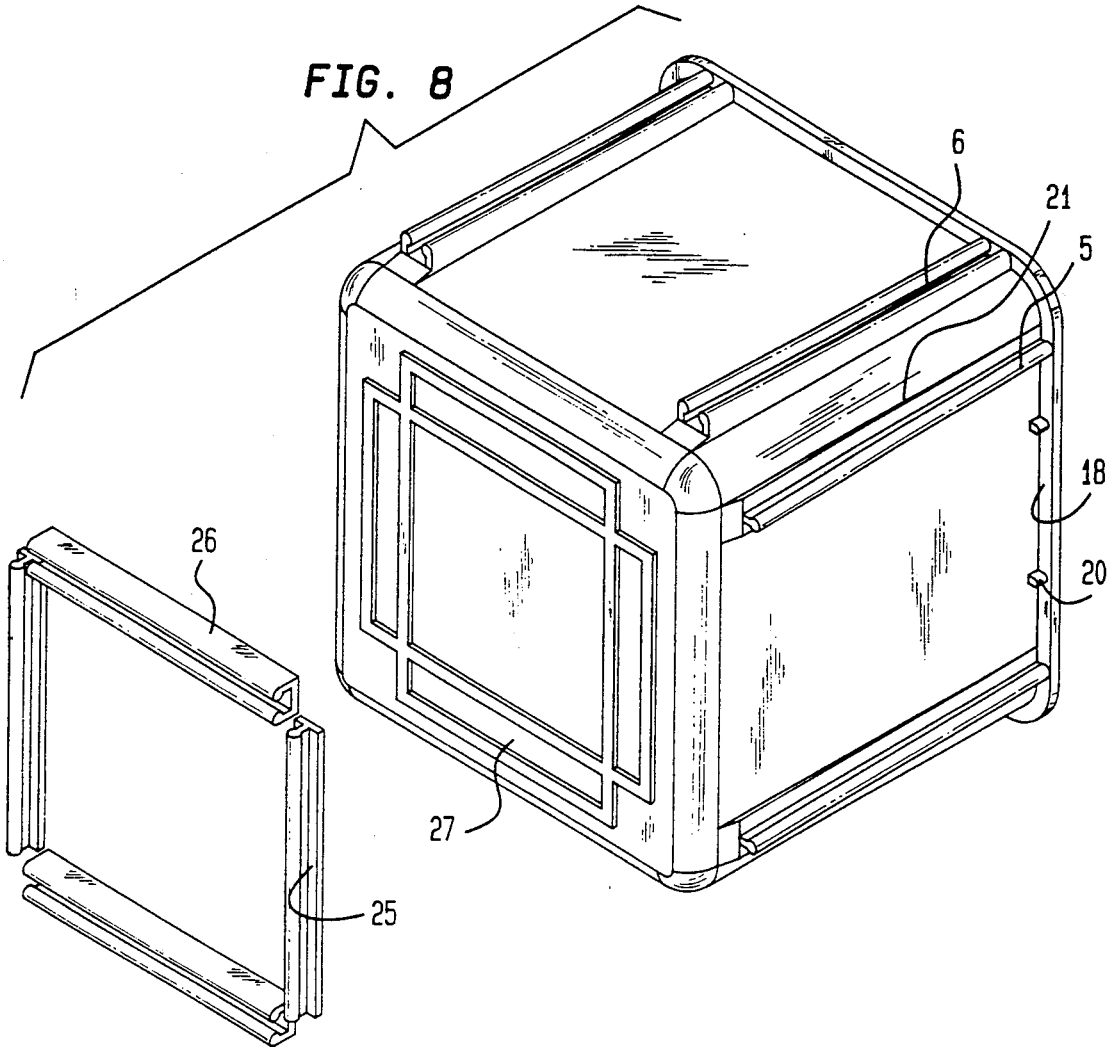
FIG. 8 is an exploded perspective view of a five-piece container.
Figure 9:
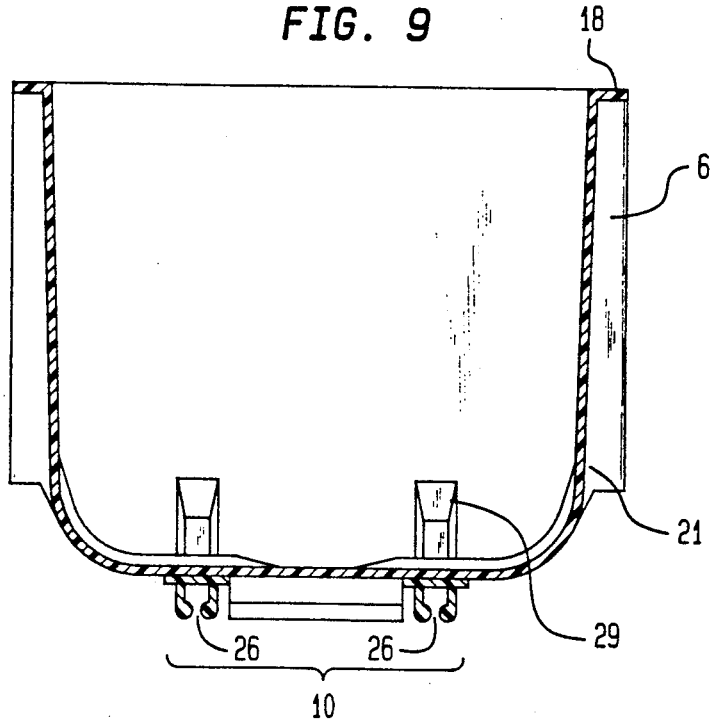
FIG. 9 shows a cross-section of FIG. 8 (as in FIG. 4) after bonding.

In the exploded view of FIG. 8, a five-piece container is illustrated, and the container is shown bonded as a completed unit in FIG. 9. The top part is identical to the above embodiment, but the bottom surface has four recesses 27 to accept the separated bottom rails and sockets 25 and 26, and to position them in the exact location for bonding. In the same manner, the side wall rails and sockets could be bonded. In this embodiment, stiffening ribs 29 are internal, leaving the bottom surface free for the bonding recesses 27.

Figure 12:
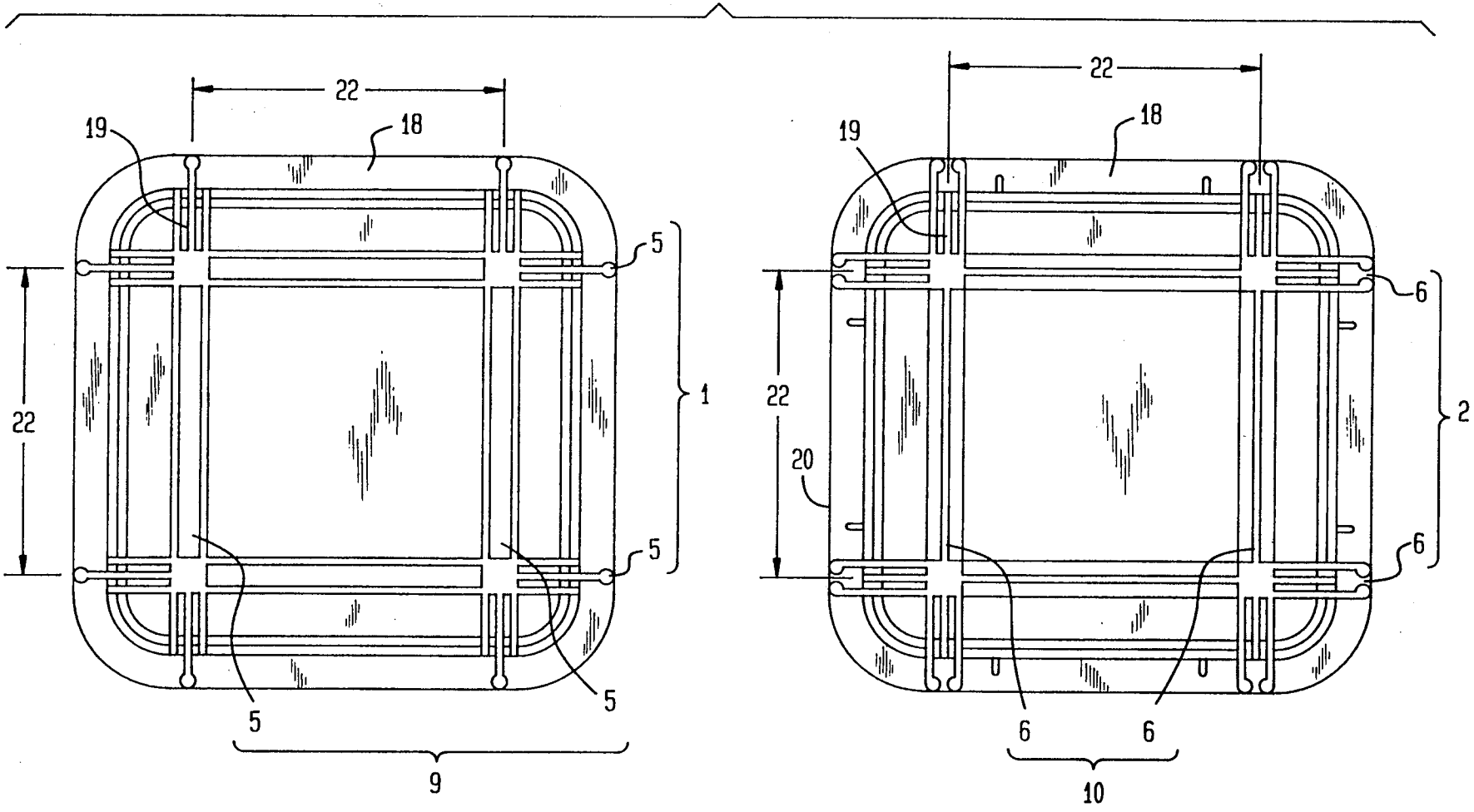
FIG. 12 provides the bottom view of another embodiment of the invention, showing a set of two complementary containers.

FIG. 12 shows a set of two complementary containers, one comprising only rails, and the other, only sockets. Assembly is possible only when using both types of containers alternately. In the same way, it is possible to manufacture in each container one rail and one socket and in the other container sockets and rails respectively arranged to fit into the first, or to fit rails to side walls and sockets to the bottom surfaces of one container, while reversing this arrangement at the other, or any other complementary arrangement using two or more containers.

Figure 10:
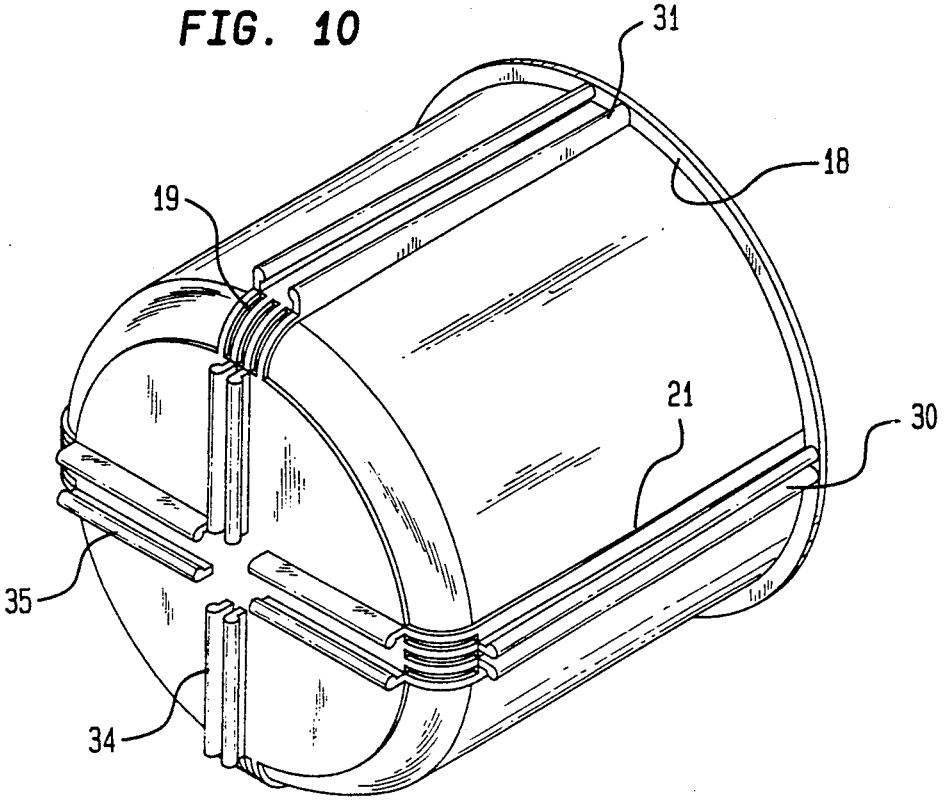
FIG. 10 is a perspective view of another preferred embodiment of the invention, showing a round-shaped container with narrow rails.

FIG. 10 illustrates another embodiment of the invention, using a round-shaped container. Here, there are two pairs of rails 30 and two sockets 31 in equal division on the circumference and two pairs of rails 34 and two sockets 35 perpendicular to each other on the bottom. The rail pairs 34 and socket 35 of the bottom surface are broken at their intersection point to enable assembling in both directions. The length of the bottom rails and sockets is the same as that of the side rails and sockets, and there is no need for the projections 20 of the above cubic embodiment.

Figure 13:
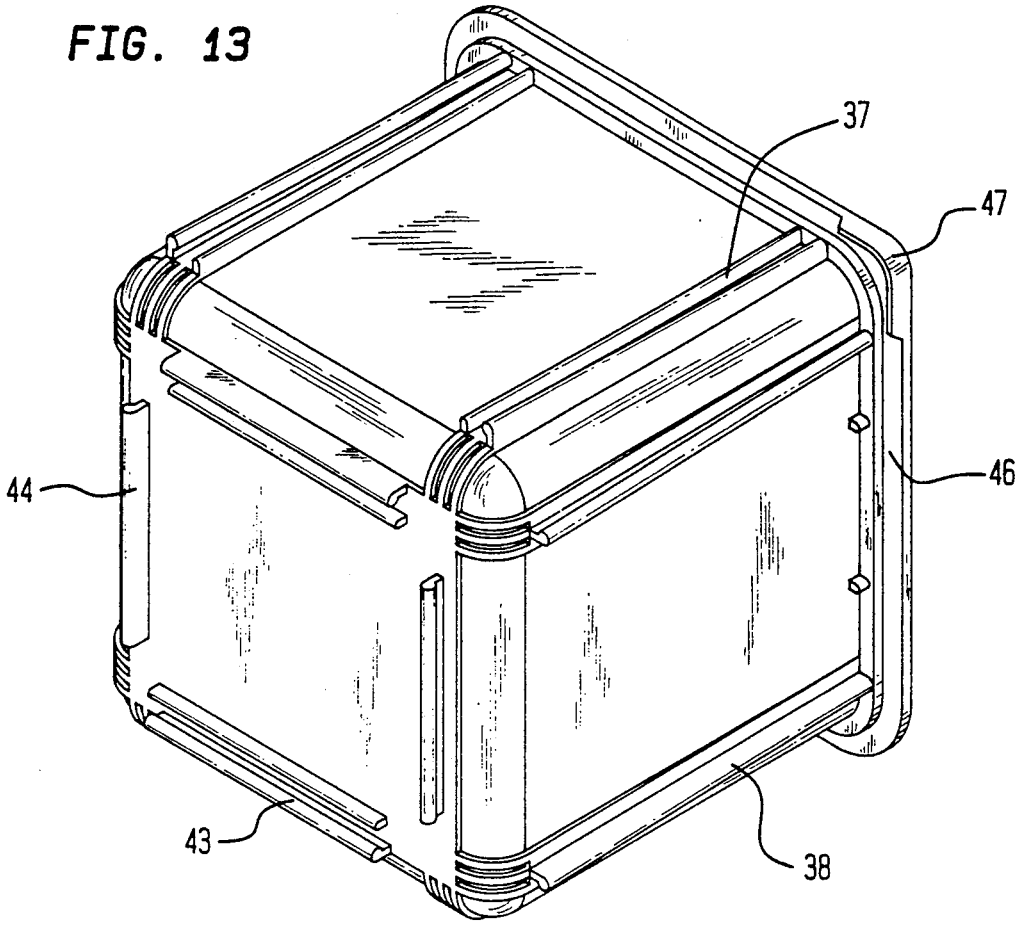
FIG. 13 is a perspective view of a container according to another embodiment of the invention.
Figure 14:
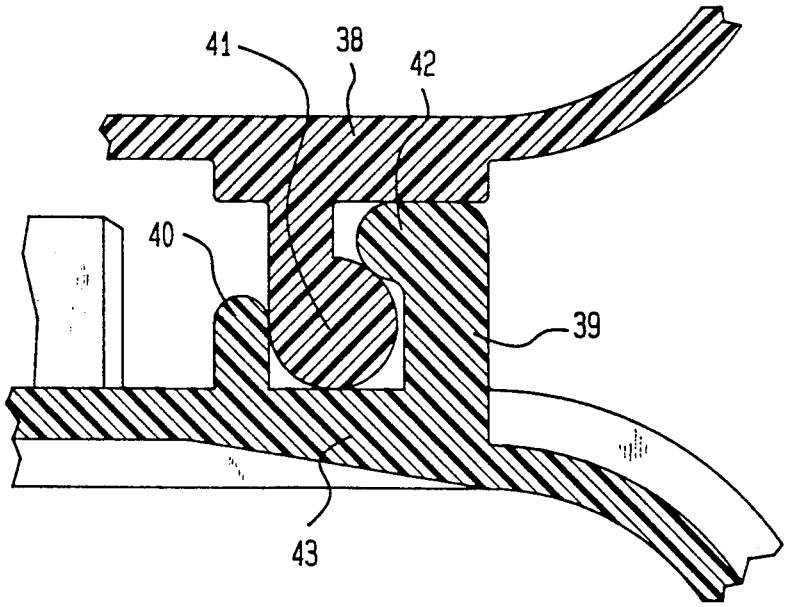
FIG. 14 is a cross-section illustrating the interlocking of rails of the embodiment of FIG. 13.

FIGS. 13 and 14 illustrate another embodiment of the invention. The important feature of this embodiment is the asymmetric shape of the side rails 38 and bottom rails 44, and the side wall sockets 37 and the bottom surface sockets 43. These rails and sockets are designed so that connection is obtained by sliding rail 38 or 44 into the sockets 37 or 43.

This is best seen in FIG. 14, in which a bottom surface socket 43 is engaged with a side wall rail 38. The socket 43 comprises two parts: a vertical strip 39, which is reshaped, with an upper portion 42, and a horizontal strip 40. The strip 40 is provided for the purpose of avoiding a lateral displacement of the rail cylinder 41 and, therefore, can be substantially shorter than strip 39, as seen in the figure.

Rail 38, which in the cross-section of FIG. 14 is seen in the mounted position, has a protruding cylinder 41 which engages the upper portion 42 of strip 39. As will be appreciated, the skilled person will be easily able to dimension the various elements of the connecting means so as to obtain a strong connection, while maintaining ease of assembly by sliding. It will also be appreciated by the skilled person that the asymmetric design of FIGS. 13–14 uses a simpler production mold.

Further seen in FIG. 13 is a removable rim or lip 46, which can be removed by pulling off at the corner provided with pulling thong 47. This is done, as explained above, once the container has been emptied of food.

As will be appreciated by a person skilled in the art, the foregoing description of preferred embodiments provides only a sample number of possible shapes, sizes, connecting and other elements, etc., and virtually countless different containers can be provided, without exceeding the scope of the invention.

Having described the invention with regard to certain specific embodiments thereof, it is to be understood that the description is not meant as a limitation since further modifications may now suggest themselves to those skilled in the art, and it is intended to cover such modifications as fall within the scope of the appended claims.

We claim:

1. A dual-purpose sealable food container/building block element comprising an upper portion extending along a longitudinal axis and a bottom portion, said upper portion being open and having a lip protruding outwardly therefrom for sealing purposes when said container element is used as a food container, characterized in that each of said upper portion and said bottom portion has mounted thereon at least one set of engageable rails and sockets, said upper portion rails and sockets extending parallel to said longitudinal axis and said bottom portion rails and sockets extending perpendicular to said longitudinal axis, such that a plurality of said container/block elements are directly connectable to one another in proximate fashion without interstitial gaps therebetween by engaging said sets of rails and sockets and sliding toward each other to a stop engagement position defined by said lip, for use of said container/block elements as a toy after completing original use as a food container.

2. The container/element of claim 1 wherein part of said lip is removable by tearing off before said container/element is adapted as a building block when used as a toy.

3. The container/element of claim 1, wherein said upper portion is provided with two rails and two sockets in equal division on the perimeter of said container and said bottom portion is provided with one rail and one socket perpendicular to each other, and broken at their intersection.

4. The container/element of claim 3 wherein said two rails on said upper portion are directly opposite each other.

5. The container/element of claim 4 wherein said plurality of rails comprises two equally distanced parallel individual rails, and wherein said plurality of sockets comprises two equally distanced parallel individual sockets.

6. The container/element of claim 3 wherein said bottom portion rail is rotated ninety degrees about center with respect to said upper portion rails.

7. The container/element of claim 3 wherein each of said rails and each of said sockets is replaced by a plurality of rails and sockets on said upper portion and on said bottom portion, and wherein said plurality of rails and sockets on said bottom portion are shorter than said plurality of rails and sockets on said upper portion.

8. The container/element of claim 3, wherein the total height of two containers assembled by upper portion rails and sockets and engaged to said stop position defined by said lip, measured from the bottom of one to the bottom of the other, is the same as the width of a single container upper portion including rails and sockets, forming a cubic construction.

9. The container/element of claim 1, wherein said upper portion is substantially tubular in shape.

10. The container/element of claim 1, wherein said upper portion is substantially parallelepipedal in shape.

11. The container/element of claim 1 wherein said lip is connected to said upper portion rails and sockets, and said upper portion rails and sockets are connected to said bottom portion rails and sockets directly.

12. The container/element of claim 1 wherein said lip is connected to said upper portion rails and sockets, and said upper portion rails and sockets are connected to said bottom portion rails and sockets by ribs which do not obstruct the open ends of said rails and sockets.

13. The container/element of claim 1 wherein a combination of a plurality of container/elements is formed by each two container/elements being connected to one another by said rails and sockets.

14. The container/element of claim 1 wherein said rails and sockets are asymmetric in shape.

15. A method of assembling a plurality of sealable food containers as a construction of building block elements, said method comprising the steps of:

providing a dual-purpose sealable food container /building block element comprising an upper portion extending along a longitudinal axis and a bottom portion, said upper portion being open and having a lip protruding outwardly therefrom for sealing purposes when said container element is used as a food container, characterized in that each of said upper portion and said bottom portion has mounted thereon at least one set of engageable rails and sockets, said upper portion rails and sockets extending parallel to said longitudinal axis and said bottom portion rails and sockets extending perpendicular to said longitudinal axis, such that a plurality of said container/block elements are directly connectable to one another in proximate fashion without interstitial gaps therebetween, and engaging said sets of rails and sockets and sliding toward each other to a stop engagement position defined by said lip, for use of said container/block elements as a toy after completing original use as a food container.

16. A dual-purpose sealable food container/building block element comprising an upper portion extending along a longitudinal axis and a bottom portion, said upper portion being open and having formed around its perimeter a lip protruding outwardly therefrom for sealing purposes when said container element is used as a food container, characterized in that each of said upper portion and said bottom portion has mounted thereon engageable rails and sockets, said upper portion having two pairs of two rails and sockets extending parallel to said longitudinal axis in equal division on said container perimeter and said bottom portion having two rails and sockets extending in a plane perpendicular to said longitudinal axis and being perpendicular to each other in said plane, such that a plurality of said container/block elements are directly connectable to one another in proximate fashion without interstitial gaps therebetween by engaging said sets of rails and sockets and sliding toward each other to a stop engagement position defined by said lip, for use of said container/-block elements as a toy after completing original use as a food container.

17. The container/clock element of claim 16, wherein said upper portion is substantially tubular in shape.

18. The container/block element of claim 16, wherein said upper portion is substantially parallelepipedal in shape.

* * * * *